United States Patent [19]

Cambell et al.

[11] 4,243,376

[45] Jan. 6, 1981

[54] FLARE

[75] Inventors: Robert A. Cambell, Weybridge; Rodney E. Witheridge, London, both of England

[73] Assignee: The British Petroleum Company Limited, London, England

[21] Appl. No.: 904,271

[22] Filed: May 9, 1978

[30] Foreign Application Priority Data

May 9, 1977 [GB] United Kingdom ..... 19290/77

[51] Int. Cl.[3] ..... F23D 13/20

[52] U.S. Cl. ..... 431/202; 431/350

[58] Field of Search ..... 431/202, 350; 239/502, 239/504

[56] References Cited

U.S. PATENT DOCUMENTS

| | | | |
|---|---|---|---|
| 3,058,515 | 10/1962 | Rein et al. | 431/350 |
| 3,429,645 | 2/1969 | Reed | 431/202 |
| 4,039,276 | 8/1977 | Reed et al. | 431/202 |

FOREIGN PATENT DOCUMENTS

| | | | |
|---|---|---|---|
| 1439706 | 6/1976 | United Kingdom | 431/202 |

*Primary Examiner*—Carroll B. Dority, Jr.
*Assistant Examiner*—Lee E. Barrett
*Attorney, Agent, or Firm*—Morgan, Finnegan, Pine, Foley & Lee

[57] ABSTRACT

Pipe flare having a flare stabilising ring at or near the gas outlet of the pipe. The ring is hollow and has holes of desired configuration and orientation through which gas may flow.

10 Claims, 2 Drawing Figures

FLARE

The present invention relates to flares and more particularly relates to flares having flame stabilisers.

The operation of chemical plants, refineries, off-shore oil production and other operations often require the safe and effective disposal of combustible gases. Several forms of flare have been used for these operations including pipe flares which are relatively simple flares formed from a vertical pipe with an open upper end at which the fuel gas is ignited. However the flares are often found to be sensitive to wind speed and variations in gas flow which can cause lift off or extinction of the flames.

The present invention is directed towards flares which are more stable and/or more easily ignited for given wind velocites and gas flow rates by the incorporation of a flame stabilising device.

Thus according to the present invention there is provided a flare comprising a substantially vertically disposed pipe adapted to be supplied with combustible gas, said pipe having a flame stabiliser comprising a ring within the pipe at or near the outlet of the pipe, the ring being hollow and having a plurality of holes therethrough.

Preferably the hollow ring is divided into a number of segments. The term "hollow ring divided into a number of segments" is also intended to include a number of straight portions of pipe arranged into the general shape of a ring or the interior of the pipe. The term "hollow ring" is also intended to include pipes of a non-circular shape. Each of the segments of the ring preferably has at least two holes therethrough. The holes are most preferably in pairs of a larger and smaller diameter on the upper and lower halves of the ring respectively, the larger diameter holes being downstream of the smaller holes with respect to the gas flow, ie. on the upper half of the ring. The larger diameter holes preferably having diameters 40–100% larger than the diameters of the smaller holes. The larger holes are preferably set at a diverging angle from the vertical axis in the direction gas flow, the preferred angle of divergence being from 30° to 60°. The upstream holes preferably have a vertical axis.

The ring preferably occupies 5 to 30% of the total cross-sectional area of the pipe and is designed to obtain optimum gas flow disturbance whilst still retaining flame stabilisation. Preferably the holes occupy 30 to 70% of the total surface area of the ring.

The ring or the segments of the ring are preferably welded to the inside of the pipe, the ring acting to deflect part of the gas flow inwardly and cause turbulence.

Alternatively the ring may be mounted on the inner wall of the pipe by means of a flange or the like preferably continuously. The mounting flange may also be perforated with holes.

The ring is made from a metal or heat resistant substance and is suitably made from steel.

Although the holes are preferably circular in shape, they may be elliptical, longitudinal or other suitable form.

It is believed that the stabilisation effect of the ring may be due to vortex formation downstream of the ring and reduction of gas velocity introduced by the gases passing through the holes and the ring.

A wind deflector may be used in conjunction with the flame stabiliser, a suitable wind deflector being described in our UK Pat. No. 795,664.

The invention also includes a method of flaring a combustible gas mixture by passing the mixture along the pipe of a flare as herinbefore described and igniting and burning the mixture at the pipe outlet.

The invention will now be described by way of example with reference to FIGS. 1 and 2 of the accompanying drawings.

The upper part of the vertical pipe flare is indicated generally by numeral 1. This is a large two foot internal diameter metal pipe of circular cross-section and is supplied with fuel gas.

Figure 1:
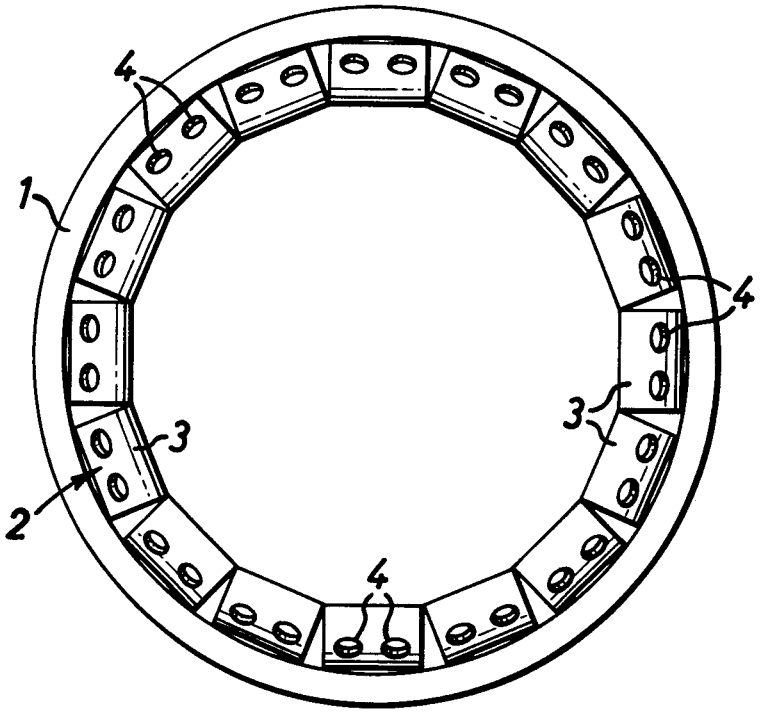
FIG. 1 shows a plan view of a pipe flare incorporating a flame stabiliser according to the invention.
Figure 2:
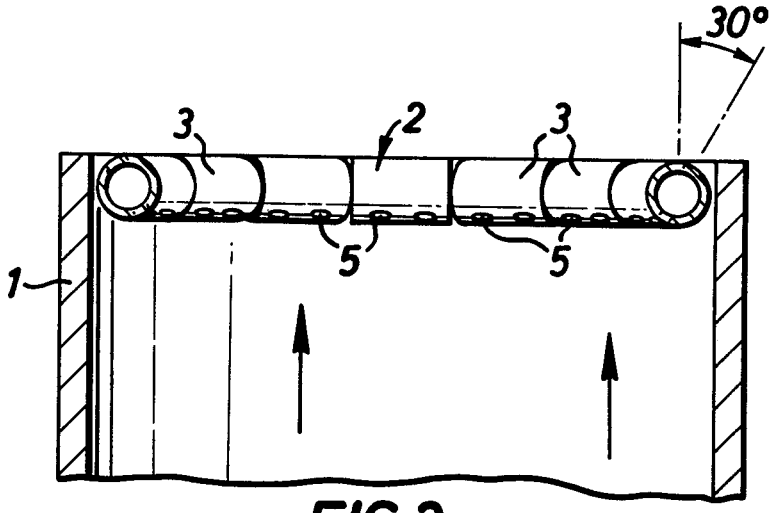
FIG. 2 shows a vertical cross-section through the same flare as FIG. 1.

A steel flame retention ring 2 is welded to the inner surface of the pipe at the mouth of the pipe. The ring 2 comprises sixteen 1½ inch outside diameter hollow circular tube segments which are welded individually to the inside wall of the pipe 1 to take the form of a ring split into segments 3. Each segment 3 of the ring 2 is pierced by four holes 4. Two of the holes 5 are of 6 mms diameter and are positioned on the upstream or lower face of the segment 3 and have a vertical axis. The other two holes 4 are of a large (10 mms) diameter than holes 4 and as shown in FIG. 1 are positioned on the downstream or upper side of the segment but at an angle of 30° to the vertical gas flow axis.

In operation of the flare, a gaseous fuel is provided from a source of supply (not shown) through the vertical pipe 1 of the flare. The fuel passing along the pipe 1 impinges upon the flame stabiliser ring 2 and a portion of the flow near the circumference of the pipe passes into and out of the holes 4, 5 thereby being mixed with air and turbulence created. The remaining portion of the flow near the circumference of the pipe is directed inwardly to mix turbulently with the central flow. The emergent fuel-air mixture is ignited above the outlet of the pipe 1, the ring 2 by deflecting the flow and creating turbulence serving to stabilise the flame.

We claim:

1. A flare comprising a substantially vertically disposed pipe adapted to be supplied with a flow of combustible gas, the pipe having a flame stabiliser comprising a ring within the pipe at or near the outlet of the pipe, the ring being hollow and having a plurality of first holes positioned in said ring upstream of the flow of combustible gas and a plurality of second holes positioned in said ring downstream of the flow of combustible gas, said plurality of first holes and said plurality of second holes being adapted to permit a portion of the flow of said combustible gas through said ring.

2. A flare according to claim 1 in which the hollow ring is divided into a number of segments, each of the segments having at least two of said plurality of first holes and at least two of said plurality of second holes.

3. A flare according to claim 1 in which the plurality of second holes are larger in diameter than said plurality of first holes.

4. A flare according to claim 3 in which the larger diameter plurality of second holes are set at a diverging angle from a vertical axis of said plurality of first holes in the direction of gas flow.

5. A flare according to claim 4 in which the angle of divergence is from 30° to 60°.

6. A flare according to claim 1 in which the ring occupies 5 to 30% of the total cross sectional area of the pipe.

7. A flare according to claim 1 in which the total area of the holes is 30 to 70% of the total surface area of the ring.

8. A flare according to claim 1 in which the plurality of first holes and the plurality of second holes have a circular, elliptical or slot shape.

9. A flare according to claim 1 in which the plurality of first holes upstream of the combustible gas flow have a vertical axis.

10. A method of flaring in which a combustible gas mixture is passed into a flare comprised of the apparatus of claim 1, said flare having an outlet and said combustible gas being ignited and burned at the outlet.

* * * * *